United States Patent [19]

Gratzer et al.

[11] 4,231,230

[45] Nov. 4, 1980

[54] REFRIGERANT ACCUMULATOR AND METHOD OF MANUFACTURE THEREOF

[75] Inventors: Nelson R. Gratzer, Germantown, Tenn.; William E. Wright, East Syracuse, N.Y.

[73] Assignee: Carrier Corporation, Syracuse, N.Y.

[21] Appl. No.: 28,932

[22] Filed: Apr. 11, 1979

[51] Int. Cl.[3] ..... F25B 43/00

[52] U.S. Cl. ..... 62/503; 138/26; 285/382; 403/284

[58] Field of Search ..... 62/503; 138/26; 403/274, 284; 285/382, 382.4

[56] References Cited

U.S. PATENT DOCUMENTS

| | | | |
|---|---|---|---|
| 1,994,210 | 3/1935 | Chobert | 285/382 |
| 3,420,071 | 1/1969 | Bottum | 62/503 |
| 3,483,714 | 12/1969 | Krause et al. | 62/503 |
| 3,512,374 | 5/1970 | Grahl | 62/503 |
| 3,563,053 | 2/1971 | Bottum | 62/503 |
| 3,643,465 | 2/1972 | Bottum | 62/503 |
| 3,643,466 | 2/1972 | Bottum | 62/503 |
| 3,655,059 | 4/1972 | Johnson | 138/26 |
| 3,698,207 | 10/1972 | Melnyk | 62/503 |
| 3,744,527 | 7/1973 | Mercier | 138/30 |
| 3,754,409 | 8/1973 | Wreen, Jr. et al. | 62/503 |
| 3,792,594 | 2/1974 | Kramer | 62/503 |
| 3,796,064 | 3/1974 | Ladusaw | 62/503 |
| 3,837,177 | 9/1974 | Rockwell et al. | 62/503 |
| 3,872,689 | 3/1975 | Bottum | 62/503 |
| 4,041,728 | 8/1977 | Morse et al. | 62/503 |
| 4,111,005 | 9/1978 | Livesay | 62/503 |

*Primary Examiner*—Ronald C. Capossela

*Attorney, Agent, or Firm*—J. Raymond Curtin; Robert P. Hayter

[57] ABSTRACT

An accumulator for use in a refrigerant circuit having a tube in which are formed inlet and discharge openings and a cylindrical shell which is deformed by metal spinning against the exterior surface of the tube to form a container which serves as the accumulator. A diverter is provided between the discharge opening and the inlet opening to prevent direct flow through the tube bypassing the container. A method of manufacture of the accumulator by metal spinning is also disclosed.

6 Claims, 2 Drawing Figures

REFRIGERANT ACCUMULATOR AND METHOD OF MANUFACTURE THEREOF

BACKGROUND OF THE INVENTION

1. Field of the Invention

The present invention relates to an accumulator. More specifically, the present invention relates to an improved accumulator and a method of assembling the refrigerant accumulator for use in a refrigeration circuit.

2. Description of the Prior Art

In a conventional vapor compression refrigeration circuit a compressor acts on refrigerant to raise its temperature and pressure. This refrigerant then is condensed from a gas to a liquid in a condenser giving off heat. This liquid then undergoes a pressure drop through an expansion device and is conducted to an evaporator where it changes state from a liquid to a gas absorbing heat during the phase change. This gaseous refrigerant is then conducted back to the compressor to complete the cycle.

Under certain operating conditions all of the liquid refrigerant may not be changed from a liquid to a gas in the evaporator. Also if the refrigerant circuit is overcharged there is an excess of refrigerant. Under either of these conditions it is possible for liquid refrigerant to pass from the evaporator to the compressor.

The compressor operates on gaseous material and consequently the entry of any liquid phase refrigerant creates potential for damage to the compressor. The entry of liquid in the form of droplets into the compressor is referred to as "slugging" and may cause crankshaft damage as well as damage to the valves and other internal mechanisms of the compressor.

A suction line accumulator may be mounted between the evaporator and the compressor to separate the liquid components from the gaseous components of the incoming stream of refrigerant fluid. The accumulator acts to temporarily retain the refrigerant in the liquid state so as to prevent liquid refrigerant from being returned to the compressor or at least to greatly reduce the possibility of such an occurrence. The accumulator may also be used to control the relative rate of flow of lubricant mixed with the refrigerant. This lubricant, typically oil, is cycled through the circuit and provides the necessary lubrication for the compressor.

In heat pumps wherein the direction of flow of refrigerant within the refrigeration circuit is reversed such that the evaporator and condenser switch functions, it is often necessary to defrost one of the heat exchangers as well as to provide for the switching between modes of operation. Depending upon the mode of operation and whether or not the unit is in defrost the quantity of refrigerant charge necessary for optimum system operation may vary. Under these conditions the accumulator may be used as a storage location for excess refrigerant within the circuit.

The accumulator described herein has a single tube to which a cylindrical shell has been mounted. Appropriate inlet and discharge openings are created in the tube such that refrigerant from the evaporator may flow into the accumulator and gaseous refrigerant together with lubricant may be discharged from the accumulator to the compressor suction line.

SUMMARY OF THE INVENTION

An object of the present invention is to provide an accumulator for use with a refrigeration circuit.

A more specific object of the present invention is to have an accumulator with two basic components.

A further object of the present invention is to provide an accumulator which may be formed by metal spinning.

A yet further object of the present invention is to provide an economical, durable, easy to assemble accumulator.

A yet further object of the present invention is to provide an economical and efficient method of manufacturing an accumulator.

The preceding objects are achieved according to a preferred embodiment of the invention by securing a cylindrical member to a tube. A single tube has inlet and discharge openings formed therein together with oil entry openings. A plug is placed in the tube between the inlet and discharge openings to prevent direct liquid refrigerant flow through the tube. A cylindrical shell is deformed onto the tube to form a container for the receipt of refrigerant. This deformation may be preferably accomplished by metal spinning and the exterior surfaces of the tube may be beaded to promote the formation of a tight joint between the tube and the shell.

DESCRIPTION OF THE PREFERRED EMBODIMENT

The embodiment of the invention described below is for use in a vapor compression refrigeration circuit typically found in an air conditioning unit. It is to be understood that the invention provides like applicability in other types of air conditioning and refrigeration circuits wherein it is beneficial to separate liquid from gas.

Figure 1:
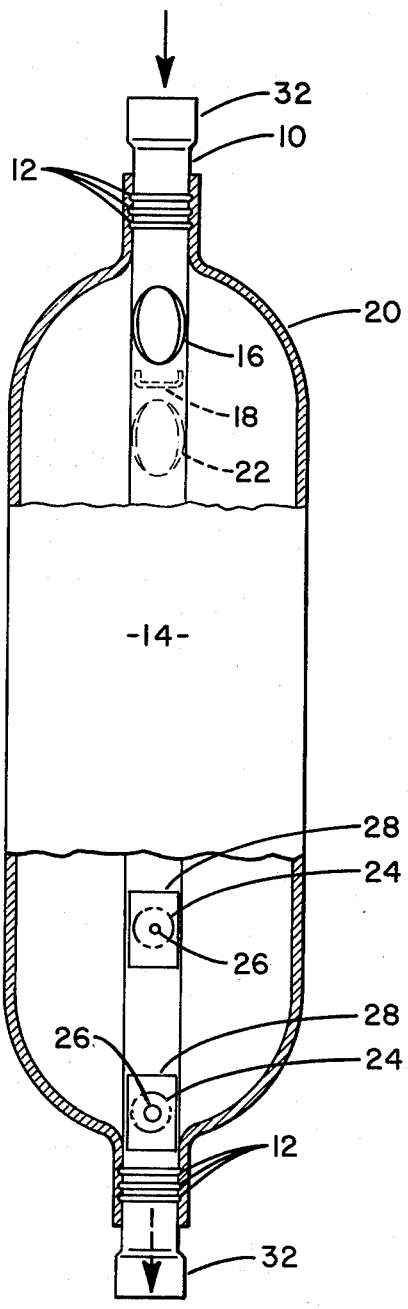
FIG. 1 is a partially cut away view of an assembled accumulator showing the tube and shell and the location of the various openings.

Referring now to the drawings, it can be seen in FIG. 1 that shell 20 is mounted to tube 10 such that a container designated as 14 is formed. Tube 10 has its outer ends belled, indicated as bell ends 32, such that they are readily adapted to be connected by soldering or otherwise to the other components of the refrigeration circuit. For the sake of clarity herein these other conventional components have not been shown.

Formed on the exterior surface of tube 10 are beads 12 located at the areas where shell 20 is deformed to meet the surface of tube 10. The provision of beads 12 helps in the making of a fluid tight seal between tube 10 and shell 20.

Discharge opening 16 is located in the tube as is entry opening 22. Plug or diverter 18 is mounted between discharge opening 16 and entry opening 22 to prevent fluid flow through the tube between the discharge opening and the entry opening. Also formed on the exterior surface of the tube is flat depressed area 24 through which oil opening 26 extends Screen 28 covers oil opening 26 such that lubricant may be allowed to pass through screen 28 into the tube while particulate matter is retained by the screen.

Figure 2:
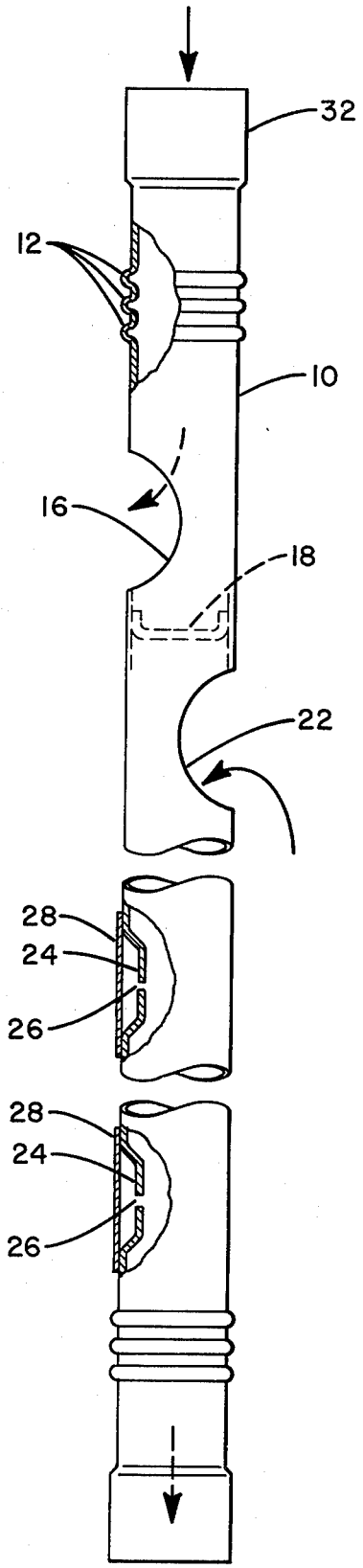
FIG. 2 is an enlarged, partially cut away side view of the tube rotated at 90° to the view of the tube in FIG. 1 showing the various openings in the tube.

In FIG. 2 which is a view of the tube in FIG. 1 with the tube having been rotated 90°, it can be seen that discharge opening 16 and inlet opening 22 are located on opposite sides of the tube such that incoming fluid is discharged into the container in one direction from discharge opening 16 and the outgoing fluid is received from the opposite side of the container through opening 22.

The accumulator as shown is designed to be mounted in an upright position such that discharge opening 16 is located further from the center of the earth than is inlet opening 22. Consequently, the entering refrigerant will be drawn by gravity from discharge opening 16 to the bottom portion of container 14. As the entering fluid is discharged into the container the liquid component of that fluid will settle at the bottom of the container and the gaseous component will be in communication with inlet opening 22. This gaseous component can then be drawn through inlet opening 22 and through tube 10 to the suction inlet of the compressor. Depending upon the operating characteristics of the system the level to which the liquid, if any, will rise in the accumulator will vary. Under extreme flooded or overcharging conditions it is possible that the liquid might reach the inlet opening 22 and consequently be conducted to the compressor.

Located closer to the center of the earth than inlet opening 22 are oil openings 26. In FIGS. 1 and 2 two openings are shown. The number of oil openings is a design choice. The lubricant mixed with the refrigerant, herein designated as oil, is typically more dense than the liquid refrigerant such that the liquid components of the entering refrigerant and oil mixture collect in the bottom of the container in separate layers, the oil forming a bottom layer and liquid refrigerant forming a layer on top of the oil. The oil will not vaporize and be returned to the compressor as gas consequently it is necessary to provide openings to allow liquid oil flow into the suction return line to the compressor. The oil openings 26 extend through the tube and are covered by screens 28 such that only a very small amount of oil may enter into the tube at any one time. Flat spots are formed in the exterior surface of the tube to promote the securing of the screens thereto. The oil passes in droplet form from the container into the tube and flows to the compressor to provide necessary lubrication.

The accumulator may be manufactured by first forming the tube and its appropriate openings and configurations. The belling of the ends and the forming of the openings may be accomplished in any conventional manner. A diverter of a conventional design may be provided between the inlet and discharge openings such that fluid flow is prevented therebetween. The number and size of beads 12 are selected and sized depending upon the application and various design. The beads may be formed by outwardly deforming a portion of the tube. Once the tube is formed the cylindrical shell is mounted about the tube and by using a metal spinning process the outer edges of the shell are compressed inwardly against the tube forming a fluid tight seal between the tube and the shell. Additionally a sealant may be used between the tube and shell to assure a fluid tight joint. The metal spinning converts a cylindrical piece of material into the shell configuration shown in FIG. 1. The curvalinear portions of the top and bottom of the shell are formed without removing material from the shell and the abutting portions of the shell and tube are such that a tight seal is formed.

From the above description it is apparent that an accumulator is formed having only two basic components. This accumulator does not require formation of separate joints or the inclusion of various internal tubes in the accumulator. Furthermore there is provided a simple one step metal spinning operation to form the accumulator after the appropriate tube configuration has been created.

The invention has been described in detail with particular reference to a preferred embodiment thereof but it will be understood that variations and modifications can be affected within the spirit and scope of the invention.

We claim:

1. An accumulator for receiving a two phase fluid mixture of refrigerant, for storing liquid refrigerant and for discharging gaseous refrigerant which comprises:

a tube mounted in a generally vertical direction having an upper end and a lower end, said tube receiving a two phase fluid mixture of refrigerant at the upper end and discharging gaseous refrigerant at the lower end;

a shell formed about and connected to the tube intermediate the ends thereof forming a container of a selected volume;

said tube having a discharge opening located near the top of the container to allow the refrigerant mixture entering the upper end of the tube to flow into the container;

said tube having an inlet opening communicating the container with the tube for discharging gaseous refrigerant from the lower end of the tube, said inlet openings being located below the discharge opening and spaced above the bottom of the container such that liquid refrigerant may collect in the lower portion of the container without being discharged from the container; and diverting means mounted in the tube between the inlet opening and the discharge opening, said diverting means acting to prevent flow of refrigerant directly from the upper end of the tube to the lower end of the tube whereby refrigerant entering the upper end of the tube flows through the discharge opening into the container and may then flow from the container through the inlet opening to the lower end of the tube.

2. The apparatus as set forth in claim 1 wherein the means for diverting refrigerant flow is a plug secured in the tube between the inlet opening and the outlet opening to prevent refrigerant flow through the tube between said openings.

3. The apparatus as set forth in claim 1 wherein the discharge opening is vertically spaced above the inlet opening and further including an oil opening formed in said tube, said oil opening being vertically spaced below the inlet opening such that oil mixed with the refrigerant may enter the tube from the container.

4. The apparatus as set forth in claim 1 wherein the tube ends are belled to facilitate joining with other components of a refrigeration circuit.

5. The apparatus as set forth in claim 1 wherein beads are formed from the wall of the tube at the area the shell is inwardly deformed to form a seal with the tube, said beads promoting the formation of a tight seal.

6. The apparatus as set forth in claim 5 wherein the shell is generally cylindrical in configuration having a first diameter portion forming the container and a second reduced diameter portion where the shell coacts with the beads of the tube to form a seal therewith.

* * * * *